US006851125B2

(12) United States Patent
Fujikawa et al.

(10) Patent No.: US 6,851,125 B2
(45) Date of Patent: Feb. 8, 2005

(54) DISPOSABLE SURGICAL GOWN

(75) Inventors: Michiyo Fujikawa, Kagawa (JP); Akiko Saito, Kagawa (JP); Takeshi Hanajiri, Kagawa (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 10/050,242

(22) Filed: Jan. 16, 2002

(65) Prior Publication Data

US 2002/0095711 A1 Jul. 25, 2002

(30) Foreign Application Priority Data

Jan. 19, 2001 (JP) ..... 2001-011892

(51) Int. Cl.[7] ..... A41D 13/00
(52) U.S. Cl. ..... 2/51; 2/114
(58) Field of Search ..... 2/114, 69, 60, 2/901, 51, 46, 83, 82, 92, 127, 129, 135, 136

(56) References Cited

U.S. PATENT DOCUMENTS 4,504,977 A * 3/1985 King et al. ..... 2/51
4,504,978 A * 3/1985 Gregory, Jr. et al. ..... 2/114 X
5,673,433 A * 10/1997 Rothrum ..... 2/46
5,813,052 A * 9/1998 Taylor ..... 2/114 X
6,378,136 B2 * 4/2002 Matsushita ..... 2/114

* cited by examiner

*Primary Examiner*—Gloria M. Hale
(74) *Attorney, Agent, or Firm*—Butzel Long

(57) ABSTRACT

A disposable surgical gown includes a main body including a front body and a back body; and sleeves extending from both sides of upper ends of the main body. The main body comprises a plurality of assembly sheets having air permeability and liquid non-permeability. The assembly sheets are bonded to each other along a continuous bonding line extending along edges of the sheets.

17 Claims, 15 Drawing Sheets

DISPOSABLE SURGICAL GOWN

CROSS REFERENCE TO RELATED APPLICATION

This application claims the priority of Application No. 2001-011892, filed Jan. 19, 2001 in Japan, the subject matter of which is incorporated herein by reference.

TECHNICAL FIELD OF THE INVENTION

The present invention relates to a protective gown that is worn by a doctor and a nurse when performing surgical operation, and more particularly, to a gown having an improved barrier or sealing property.

BACKGROUND OF THE INVENTION

Conventionally, a disposable surgical gown includes a main body and sleeves, which are sewed to each other by a sewing machine using threads.

Japanese Laying-Open Publication Kokai No. H04-50304 discloses to employ ultrasonic thermal fusion bonding as a means for bonding a main body to sleeves and to thermal fusion bond them at the same time so as to cover the bonding portion with a different member. Airtightness is improved by covering the bonding portion with the different member.

However, it is difficult for conventional methods to sufficiently prevent infection of disease between patients and wearers (doctors and nurses) of the gown. Further, the method disclosed in Japanese Laying-Open Publication Kokai No. H04-50304 makes a manufacturing process complex and is also disadvantageous in cost because it uses the extra member.

OBJECTS OF THE INVENTION

Accordingly, it is an object of the present invention, which was made in view of the above circumstances, to provide a disposable surgical gown capable of contributing to the improvement of a blocking effect for blocking an infection route between patients and wearers of the gown by preventing the exudation of blood and the like during surgical operation regardless of that the gown is arranged simply.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to a first aspect of the present invention, a disposable surgical gown, includes a main body including a front body and a back body; and sleeves extending from both sides of upper ends of the main body. The main body comprises a plurality of assembly sheets having air permeability and liquid non-permeability. The assembly sheets are bonded to each other along a continuous bonding line extending along edges of the sheets.

According to the above-described invention, the continuously formed bonding line can prevent the exudation of substances such as blood from the bonding portion of the sheets. As a result, it is possible to improve the effect of preventing infection between a patient and a wearer (doctor or nurse) of the gown.

It is preferable that a plurality of discontinuous bonding portions be formed in the vicinity of the continuous bonding line (both of them are disposed together). With this device, when the sheets constituting the gown are bonded to each other by, for example, an ultrasonic sewing machine, and the like, a pressure can be dispersed in the direction perpendicular to the flow direction of the sheets, and the breakage of the gown, which would be caused by the concentration of the pressure to a local area of the continuous bonding line, can be prevented.

According to a second aspect of the present invention, a disposable surgical gown includes a main body including a front body and a back body; sleeves extending from both sides of upper ends of the main body; and an auxiliary member, which is provided at an inner upper end of the back body. The auxiliary member is folded by an assistant when the gown is worn by a wearer.

Preferably, the auxiliary member comprises two parts which are arranged at upper corners of the back body. The two parts of the auxiliary member may be shaped to be triangle pockets.

According to a third aspect of the present invention, a disposable surgical gown includes a main body including a front body and a back body; sleeves extending from both sides of upper ends of the main body; and an water-absorbent sheet provided around a neck portion of the front body for absorbing sweat of a wearer.

Preferably, the water-absorbent sheet is shaped and arranged so as not to extend outwardly from an upper edge of the front body.

DETAILED DISCLOSURE OF THE INVENTION

In the following detailed description of the preferred embodiments, reference is made to the accompanying drawings which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and scope of the present inventions is defined only by the appended claims.

An embodiment of the present invention will be described below. A gown according to this embodiment is used as a disposable gown that is worn by doctors, nurses, and the like in surgical operation. The gown of the present invention can be also applied to medical fields other than operation where it is necessary to block the infection route of disease-causing germs and to fields other than the medical field where high liquid tightness, dust controllability, and the like are required.

Figure 1:
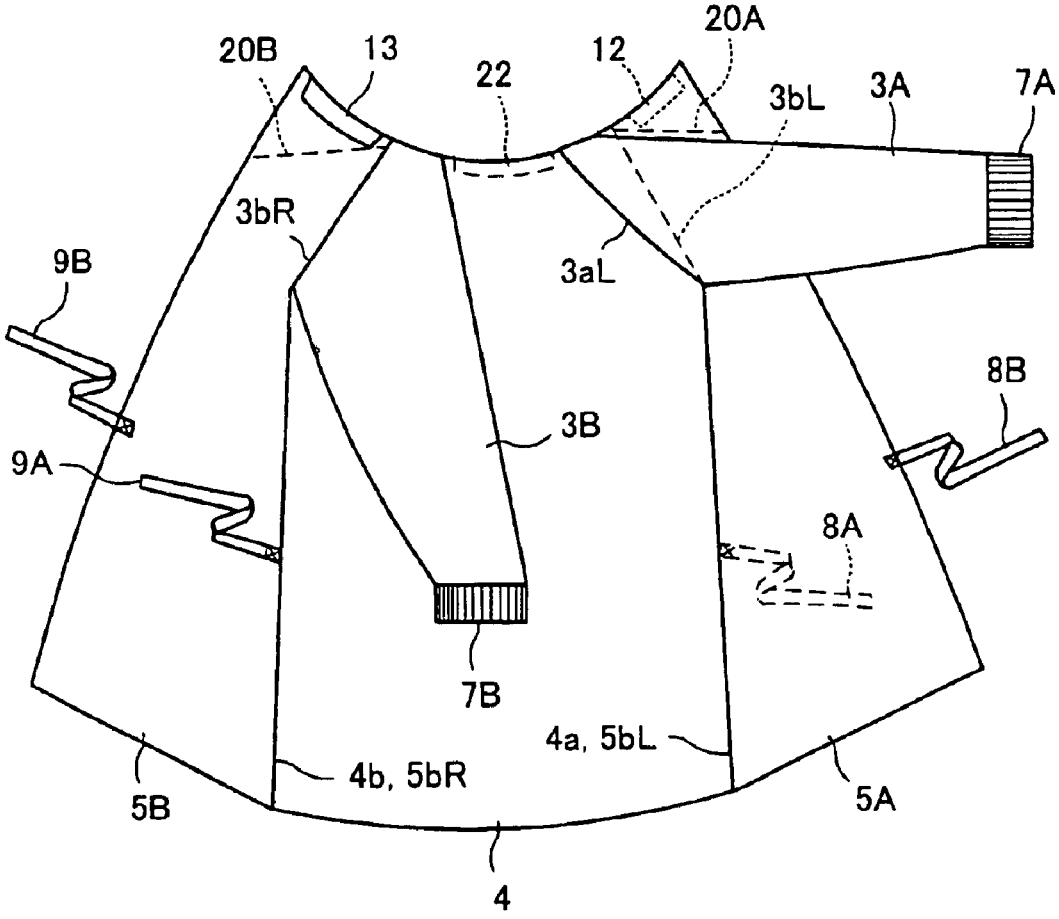
FIG. 1 is a front view showing the structure of a surgical gown of according to an embodiment of the present invention, in which the gown is spread right and left and viewed from a front body side.
Figure 2:
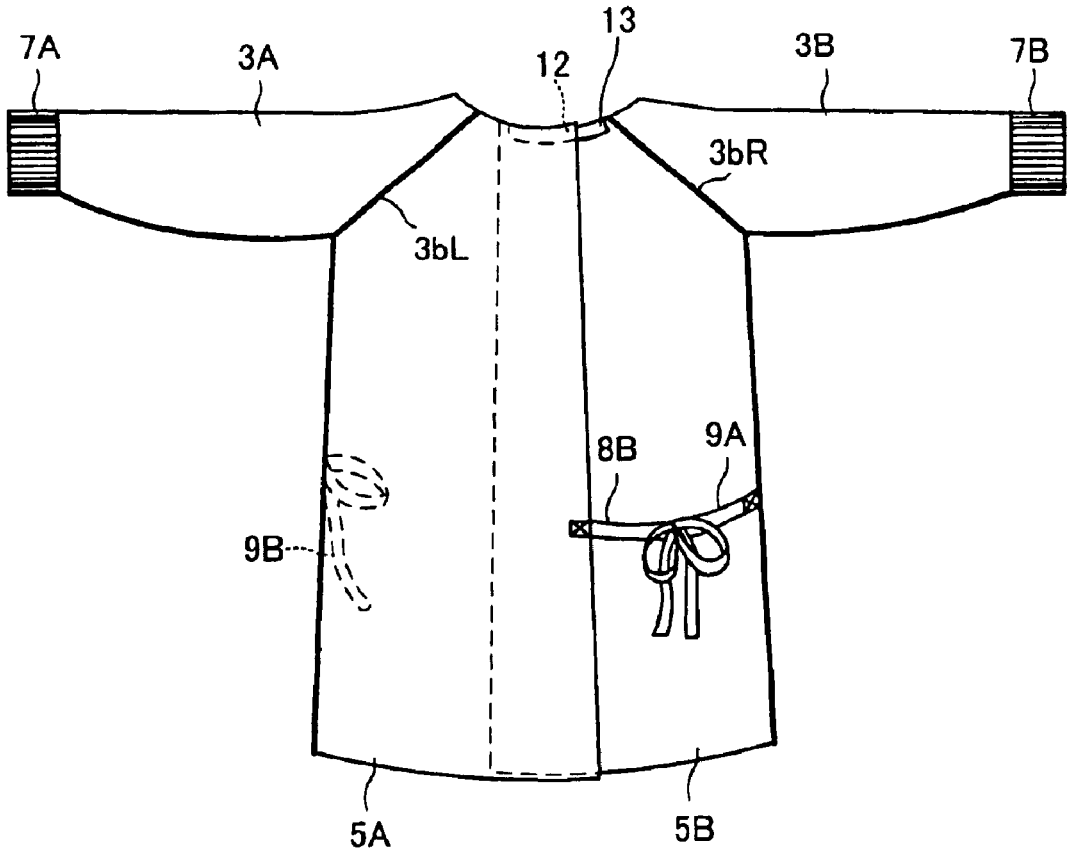
FIG. 2 is a rear view showing the surgical gown according to the embodiment, in which the gown is worn and viewed from a back body side.
Figure 3:
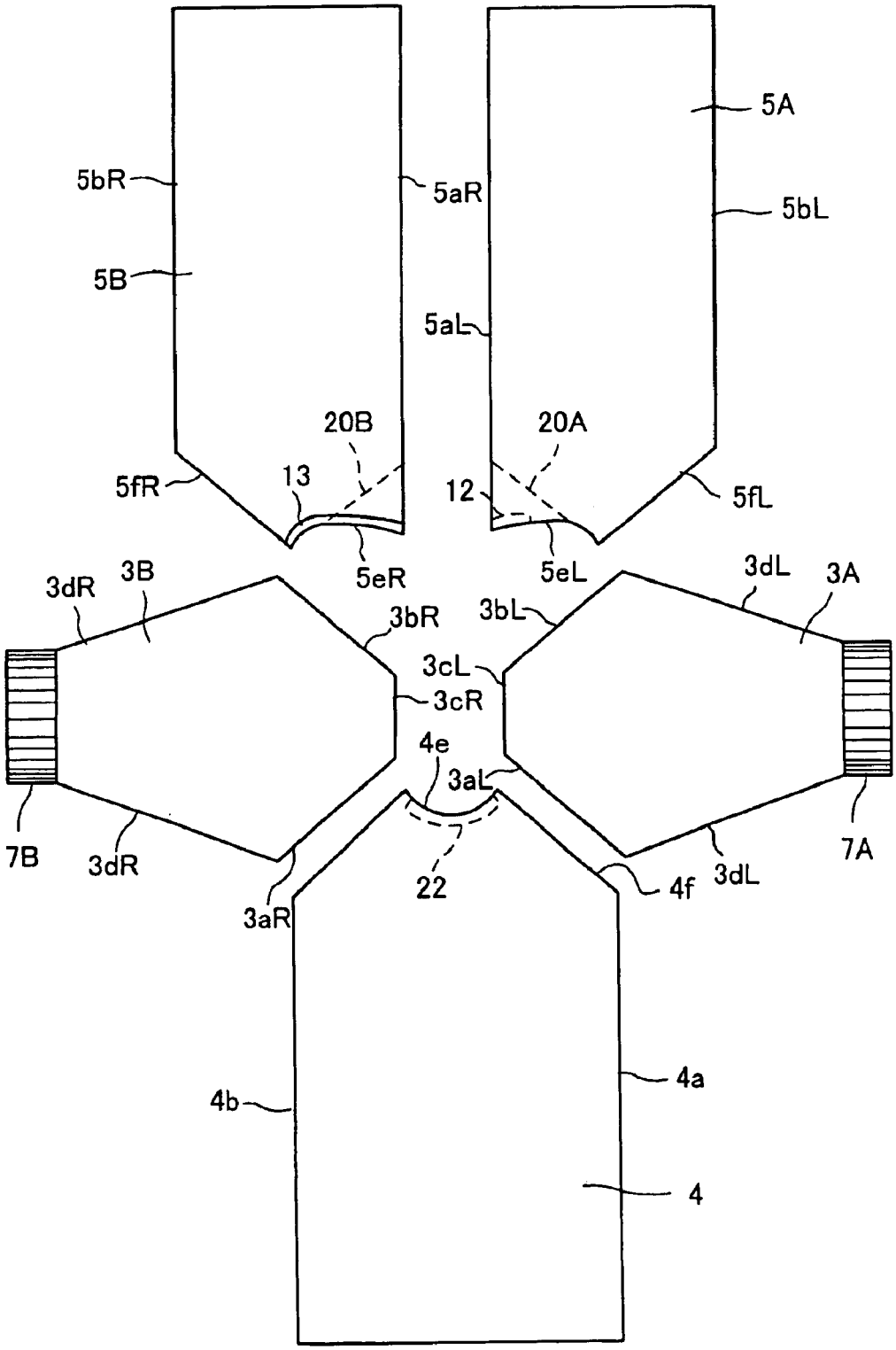
FIG. 3 is a plan view showing the surgical gown according to the embodiment in a disassembled state before component parts thereof are bonded to each other.

FIG. 1 is a front view showing the arrangement of the surgical gown of the embodiment when it is spread and viewed from a front body side. FIG. 2 is a rear view showing the gown when it is worn and viewed from a back body side. Further, FIG. 3 is a plan view showing the gown in a disassembled state before the members thereof are bonded to each other (assembled).

The surgical gown according to the embodiment includes a front body 4, a left back body 5A, a right back body 5B, and both sleeves 3A and 3B. The front body 4 includes a single sheet. A back body includes two sheets 5A and 5B such that when the gown is worn, free side edges (5*a*L and 5*a*R) are put together on the back of a wearer. Waist belts 8A, 8B, 9A, and 9B are attached to the side edges of the back bodies 5A and 5B. Further, a hook portion 12 and a loop portion 13 that constitute a mechanical fastener are attached to neckline portions of the back bodies 5B and 5A, respectively. Elastic sleeve ribs 7A and 7B are provided at cuffs of both the sleeves 3A and 3B.

In the surgical gown according to the embodiment, fusion bonding by means of an ultrasonic sewing machine, or the like or bonding by means of an adhesive is carried out to bond the lower sleeve portions 3*d*L and 3*d*R of both the sleeves 3A and 3B to each other; to bond the sleeve attachment portion 3*a*L of the left sleeve 3A to the arm hole 4*f* of the front body 4; to bond the sleeve attachment portion 3*a*R of the right sleeve 3B to the arm hole 4*f* of the front body 4; to bond the sleeve attachment portion 3*b*L of the left sleeve 3A to the arm hole 5*f*L of the back body 5A; to bond the sleeve attachment portion 3*b*R of the right sleeve 3B to the arm hole 5*f*R of the back body 5B; to bond the left side edge 4*a* of the front body 4 to the fixed side edge 5*b*L of the back body 5A; and to bond the right side edge 4*b* of the front body 4 to the fixed side edge 5*b*R of the back body 5B, respectively.

Thermal sealing, sonic sealing performed by ultrasonic waves, and the like are exemplified as a means for performing fusion bonding. Further, bonding performed by means of a hot-melt adhesive, and the like are exemplified as the bonding by means of the adhesive. Note that a material of a sheet and a method of bonding the sheet will be described below.

Figure 4:
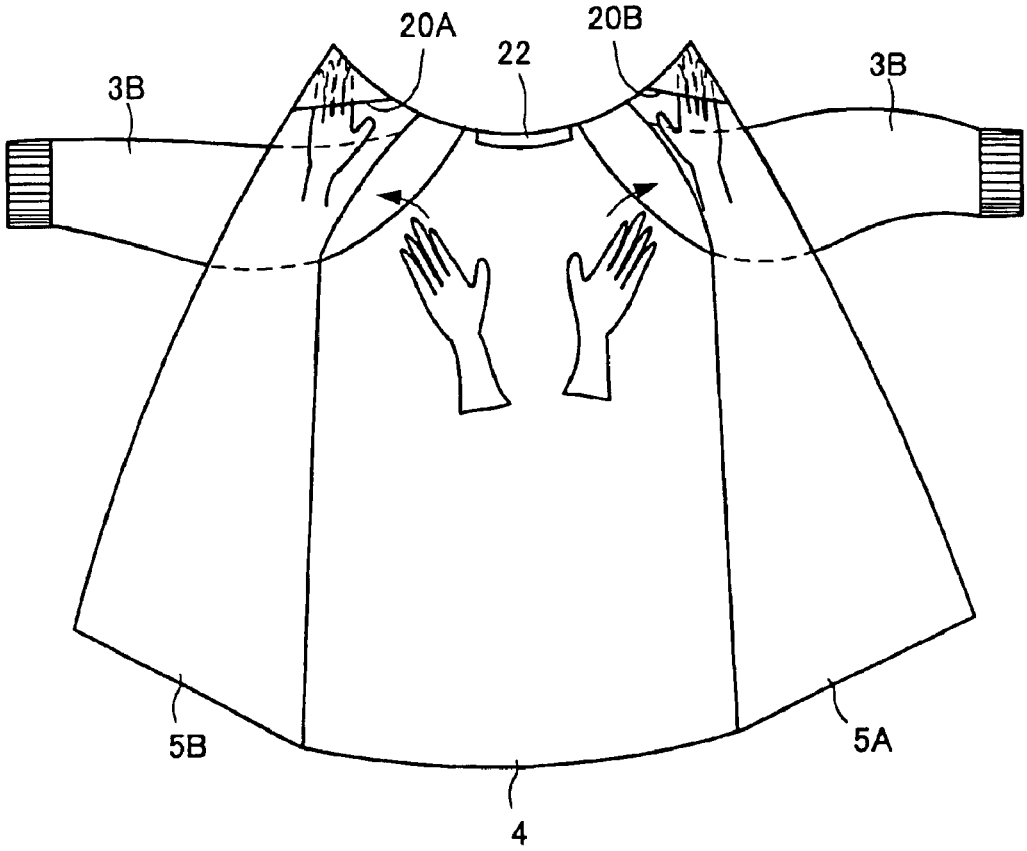
FIG. 4 is a view explaining a manner when the surgical gown according to the present invention is spread and worn from a back side.

Triangular auxiliary pockets 20A and 20B are disposed to the upper back end corners of the free side edges 5*a*L and 5*a*R of the back bodies 5A and 5B, respectively. FIG. 4 is a view showing a method of spreading the gown according to the embodiment and wearing it from a back side. The auxiliary pockets 20A and 20B are used by an assistant such as a nurse, or the like who assists a doctor, or the like when he or she wears the gown. At that time, the assistant spreads the gown right and left with hands inserted into the auxiliary pockets 20A and 20B. With this operation, the doctor, or the like can wear the gown without being in contact with external unwanted bacteria. Note that members having a shape other than the pocket shape such as belt-like members may be employed in place of the auxiliary pockets 20A and 20B. In short, various types of members can be applied as long as they permit the assistant to spread the gown in the inside thereof and to hold it.

It is preferable that the auxiliary pockets 20A and 20B be located as near to the upper end corners as possible because the main body of the gown is composed a flexible and soft material. With this arrangement, it can be prevented that the upper end corners of the gown are bent downward when it is spread with hands inserted into the auxiliary pockets 20A and 20B and that the smooth wearing of the gown is disturbed thereby.

Figure 5:
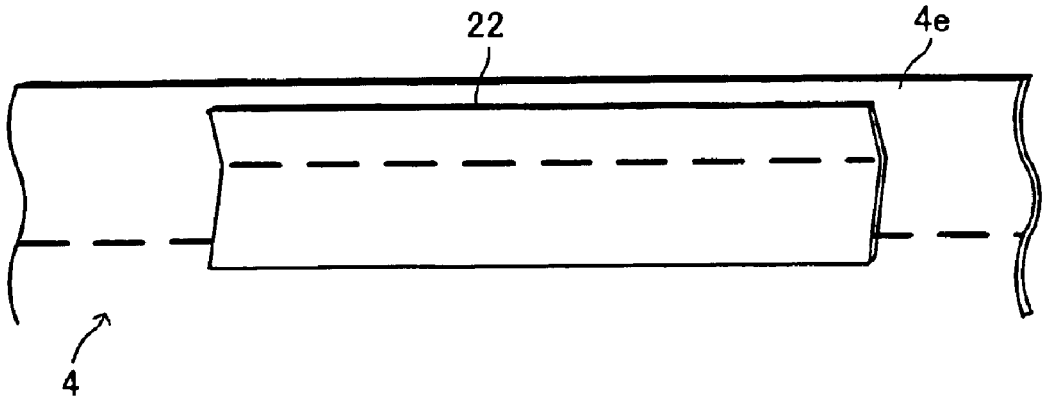
FIG. 5 is a perspective view showing the structure of an absorbent sheet used in the surgical gown according to the embodiment and a state in which the absorbent sheet is used.

An absorbent sheet 22 for absorbing sweat of the wearer is attached to the inside of the neckline portion 4*e* of the front body 4. As shown by a dotted line in FIG. 5, when the absorbent sheet 22 is used, the portion thereof upper than a central portion is bonded to the inside surface of the neckline portion 4*e* of the front body 4. When the absorbent sheet 22 is attached, it is important that the upper end portion thereof does not project above the neckline portion 4*e*. In other words, the absorbent sheet 22 does not extend outwardly from the top edge of the front body 4. When the upper end portion of the absorbent sheet 22 projects above the neckline portion 4*e*, it is exposed to the outside of the gown, which is not preferable from a sanitary point of view. Further, it is important to secure the portion of the absorbent sheet 22 located upper than the central portion. This is because that when a structure, in which the portion of the absorbent sheet lower than the central portion is secured, is employed, the upper side portion of the absorption sheet 22 hangs down, and thereby the wearing property (fitting property) of the gown to the wearer is impaired.

Non-woven fabric such as spun lace, and thermal bond can be used as the material of the absorbent sheet 22. The non-woven fabric that constitutes the absorbent sheet 22 includes, for example, 30 to 90% of thermosetting resin fibers and 10 to 70% of absorbent fibers. The thermosetting fibers are selected from olefin fibers such as polyethylene fibers, polypropylene fibers, etc., polyester fibers, and polyamide fibers. The absorbent fibers can be selected from pulp, cotton, rayon, acetate, etc.

Next, the material and the bonding method of the sheet that constitutes the surgical gown according to the embodiment will be described in detail. FIGS. 6 to 15 show the bonding patterns of the bonding portion of the surgical gown of the embodiment. When a sonic sewing machine is used, a fusion pattern (welding pattern) corresponding to any of these patterns is formed on the surface of a roll. Note that, the portions filled in with slanted lines in the respective figures show bonding regions, and further arrows show the direction in which the sheet flows.

Figure 6:
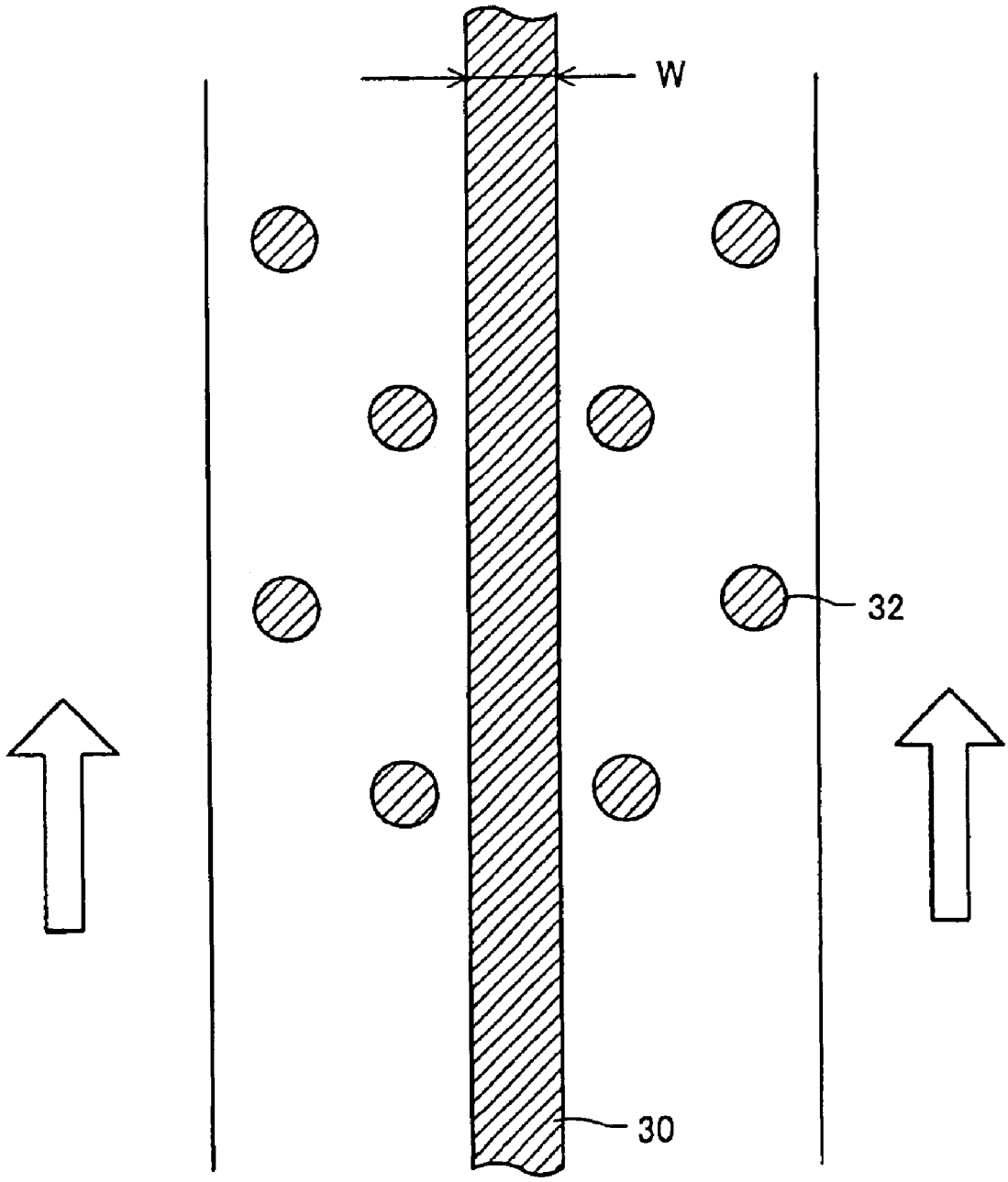
FIG. 6 is a plan view showing an example of the bonding pattern of the surgical gown according to the embodiment.

The bonding pattern shown in FIG. 6 includes a linear portion (straight portion) 30 and a plurality of dot patterns 32 arranged on the both sides of the linear portion 30. The bonding line is formed while the sheets are flowing along an assembly line. For example, the width W of the linear portion 30 in the direction perpendicular to the flow direction of the sheets is set to 1 mm, the diameter of the respective dot patterns 32 is set to 1 mm, the center distance between outer dot patterns 32 is set to about 6 mm, and the center line (pitch) of dot patterns 32 that are juxtaposed in the flow direction of the sheets is set to about 2.5 mm.

Figure 7:
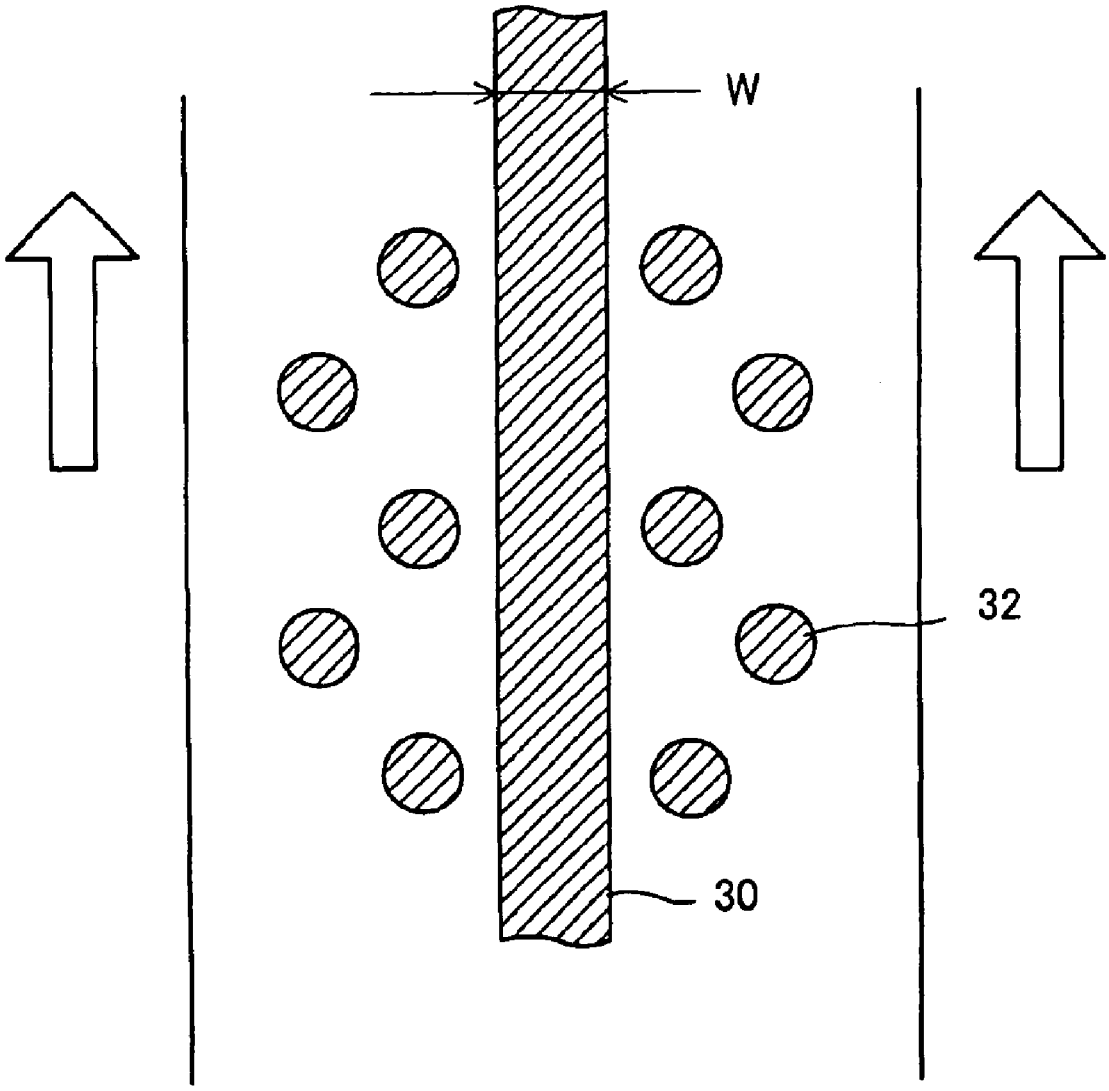
FIG. 7 is a plan view showing an example of the bonding pattern of the surgical gown according to the embodiment.

While the bonding pattern shown in FIG. 7 is similar to the bonding pattern shown in FIG. 6, the intervals between dot patterns 32 are somewhat narrowed. For example, the width W of a linear portion 30 in the direction perpendicular to the flow direction of the sheets is set to 1 mm, the diameter of respective dot patterns 32 is set to 1 mm, the center distance between outer dot patterns 32 is set to about 4.6 mm, and the center distance between dot patterns 32 that are juxtaposed in the flow direction of the sheets is set to about 2.0 mm.

Figure 8:
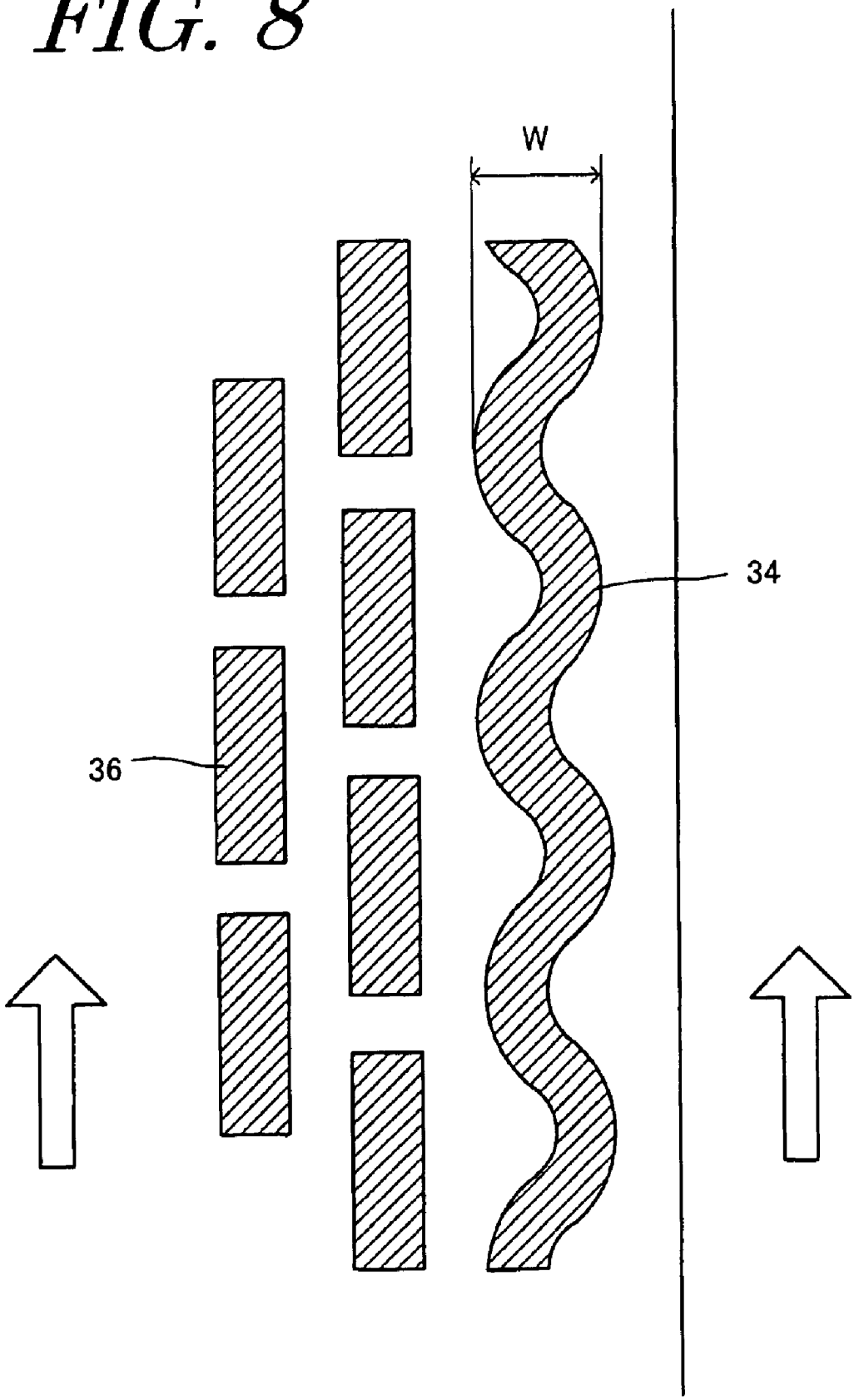
FIG. 8 is a plan view showing an example of the bonding pattern of the surgical gown according to the embodiment.

The bonding pattern shown in FIG. 8 includes a continuous wave-shaped portion 34 and two lanes of rectangular patterns 36 arranged inwardly of the sheet. For example, the maximum width (amplitude) W1 of the wave-shaped portion 34 in the direction perpendicular to the flow direction of the sheets is set to of 2 mm, the lateral width (length in the flow direction of the sheets) of the respective rectangular patterns 36 is set to 3 mm, and the interval between the respective rectangular patterns 36 that are juxtaposed in the flow direction of the sheets is set to about 0.8 mm.

Figure 9:
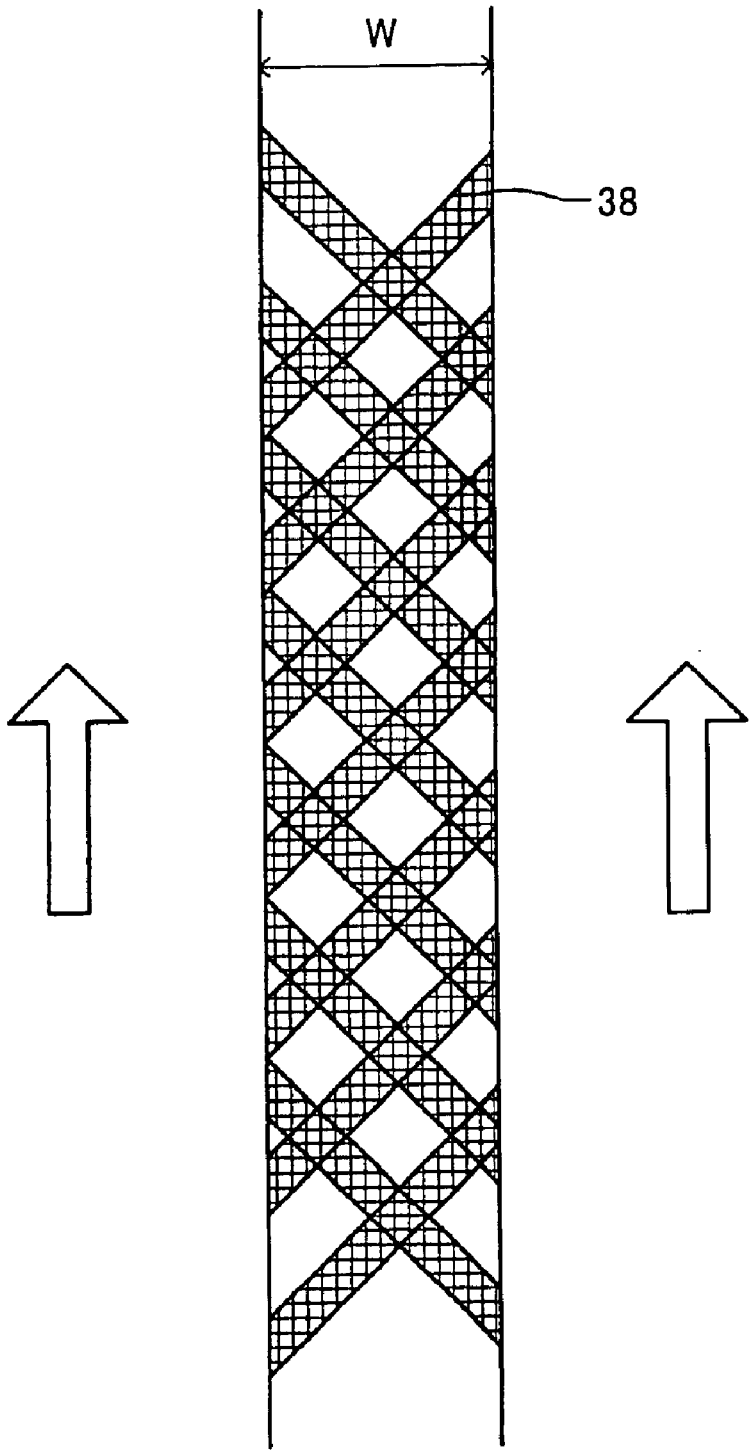
FIG. 9 is a plan view showing an example of the bonding pattern of the surgical gown according to the embodiment.

The bonding pattern shown in FIG. 9 includes a lattice-shaped pattern 38 that intersects at an angle of 45°. For example, the total width W of the lattice-shaped pattern 38 in the direction perpendicular to the flow direction of the sheets is set to 5 mm, the width of the respective stripes that constitutes a lattice is set to 1 mm, and the pitch of parallel stripes is set to about 2.5 mm.

Figure 10:
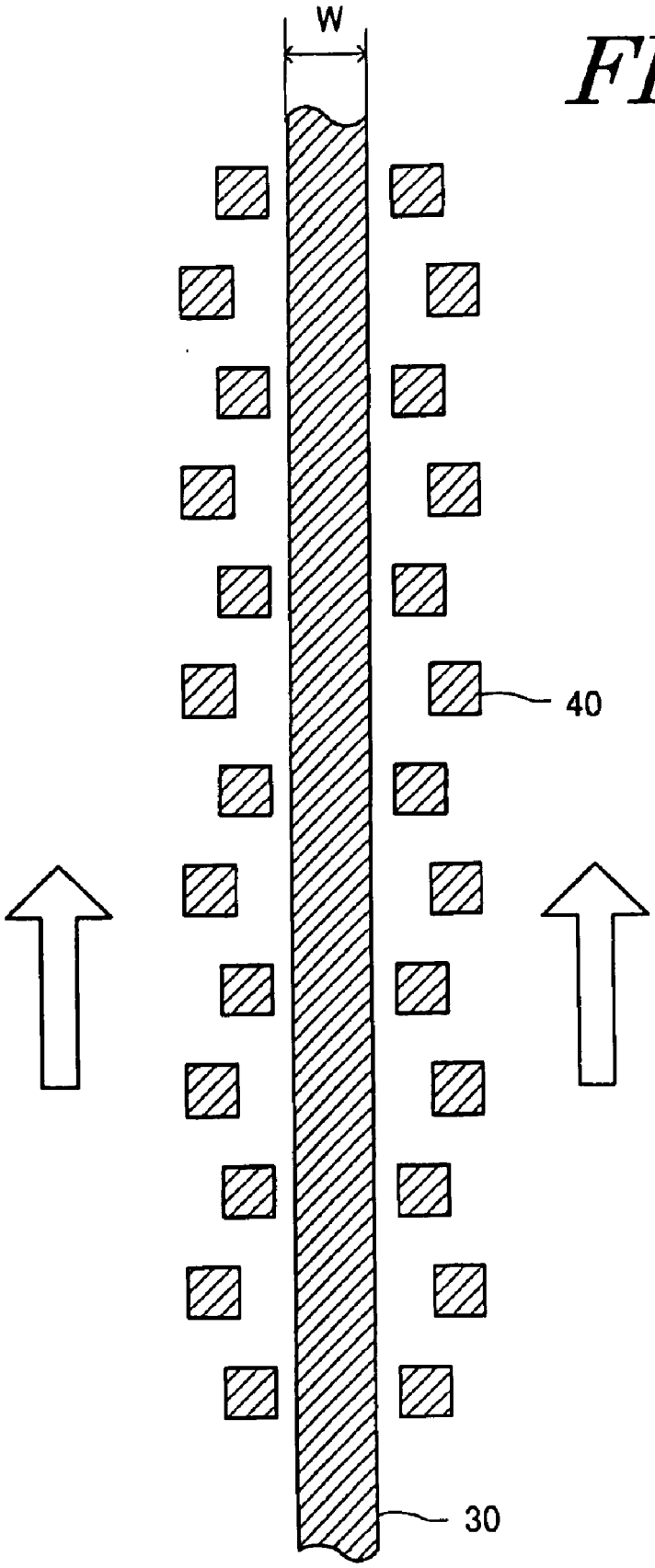
FIG. 10 is a plan view showing an example of the bonding pattern of the surgical gown according to the embodiment.

The bonding pattern shown in FIG. 10 includes a single linear portion 30 and a plurality of rectangular (square) patterns 40 arranged on both the sides of the linear portion 30. For example, the with W of the linear portion 30 in the direction perpendicular to the flow direction of the sheets is set to 1 mm, the length of on side of the respective rectangular patterns 40 is set to 1 mm, the center distance between outer rectangular patterns 40 is set to about 4.6 mm, and the center distance between rectangular patterns 40 that are juxtaposed in the flow direction of the sheets is set to about 2.0 mm.

Figure 11:
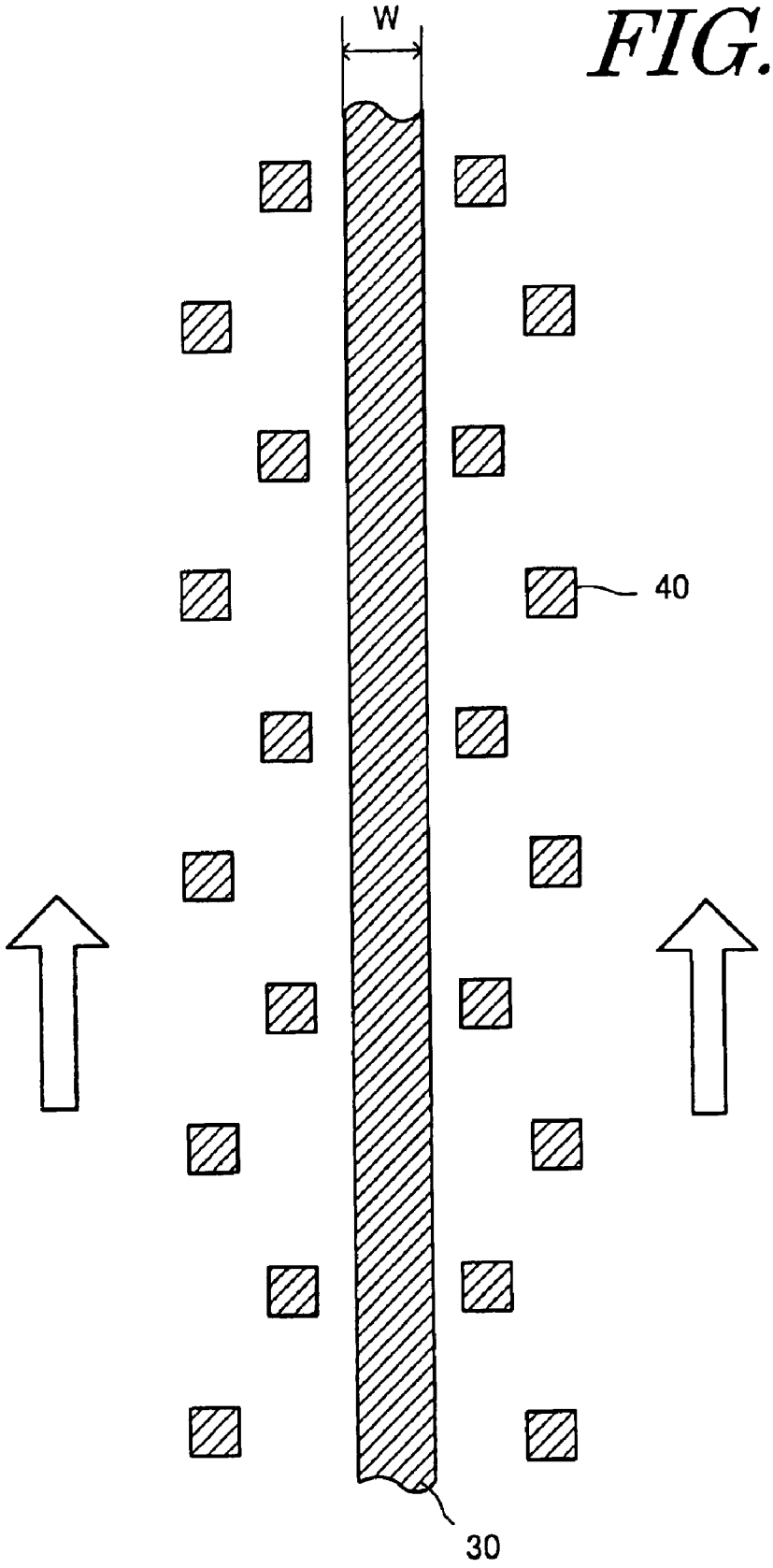
FIG. 11 is a plan view showing an example of the bonding pattern of the surgical gown according to the embodiment.

While the bonding pattern shown in FIG. 11 is similar to the bonding pattern shown in FIG. 10, the intervals between rectangular patterns 40 are somewhat widened. For example, the width W of a linear portion 30 in the direction perpendicular to the flow direction of the sheets is set to 1 mm, the length of one side of respective rectangular patterns 40 is set to 1 mm, the center distance between outer rectangular patterns 40 is set to about 6 mm, and the center distance between rectangular patterns 40 that are juxtaposed in the direction perpendicular to the flow direction of the sheets is set to about 2.5 mm.

Figure 12:
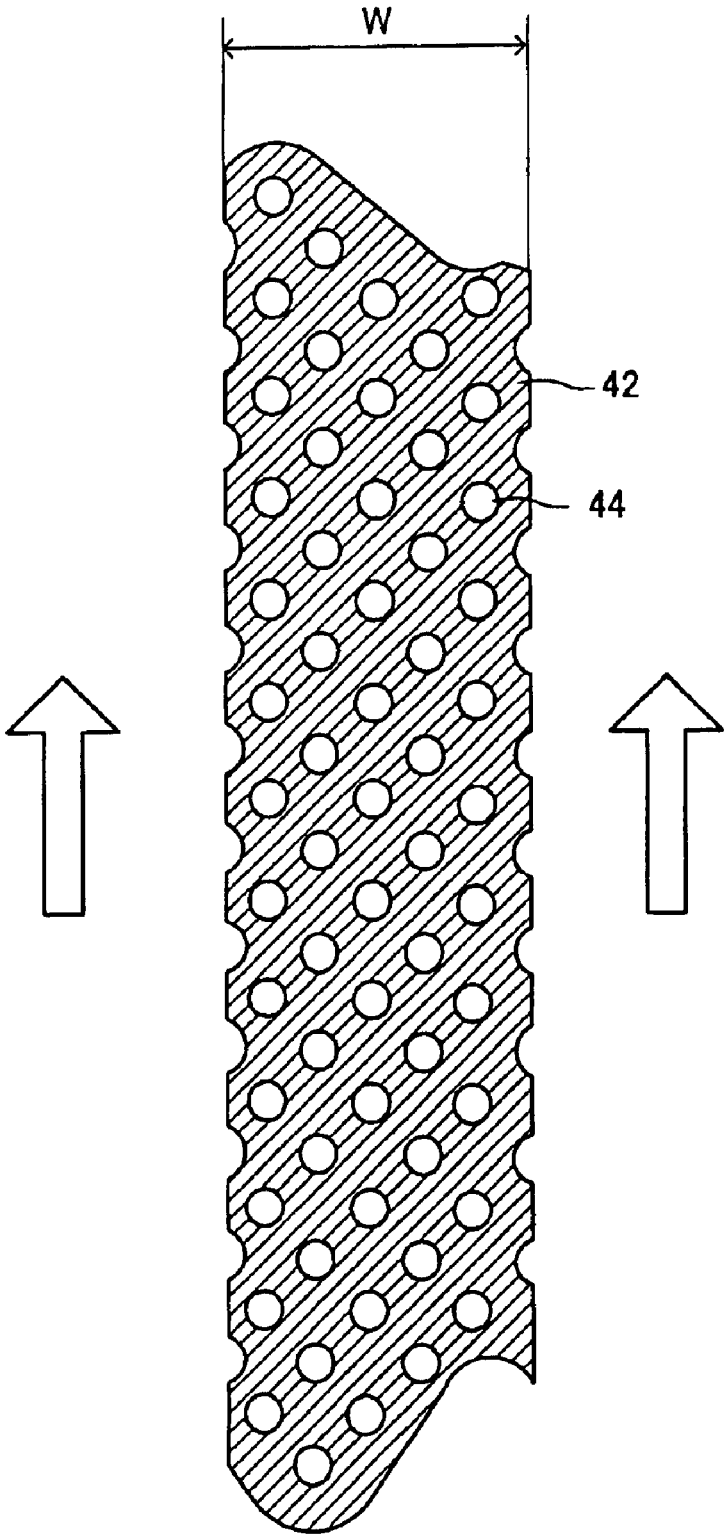
FIG. 12 is a plan view showing an example of the bonding pattern of the surgical gown according to the embodiment.

The bonding pattern shown in FIG. 12 includes a thick linear bonding line 42 and a multiplicity of dot-shaped non-bonding portions 44 defined in the bonding line 42. For example, the width W of the bonding line 42 in the direction perpendicular to the flow direction of the sheets is set to 7 mm, the center distance (pitch) between the respective dot patterns 44 is set to 1.2 mm.

Figure 13:
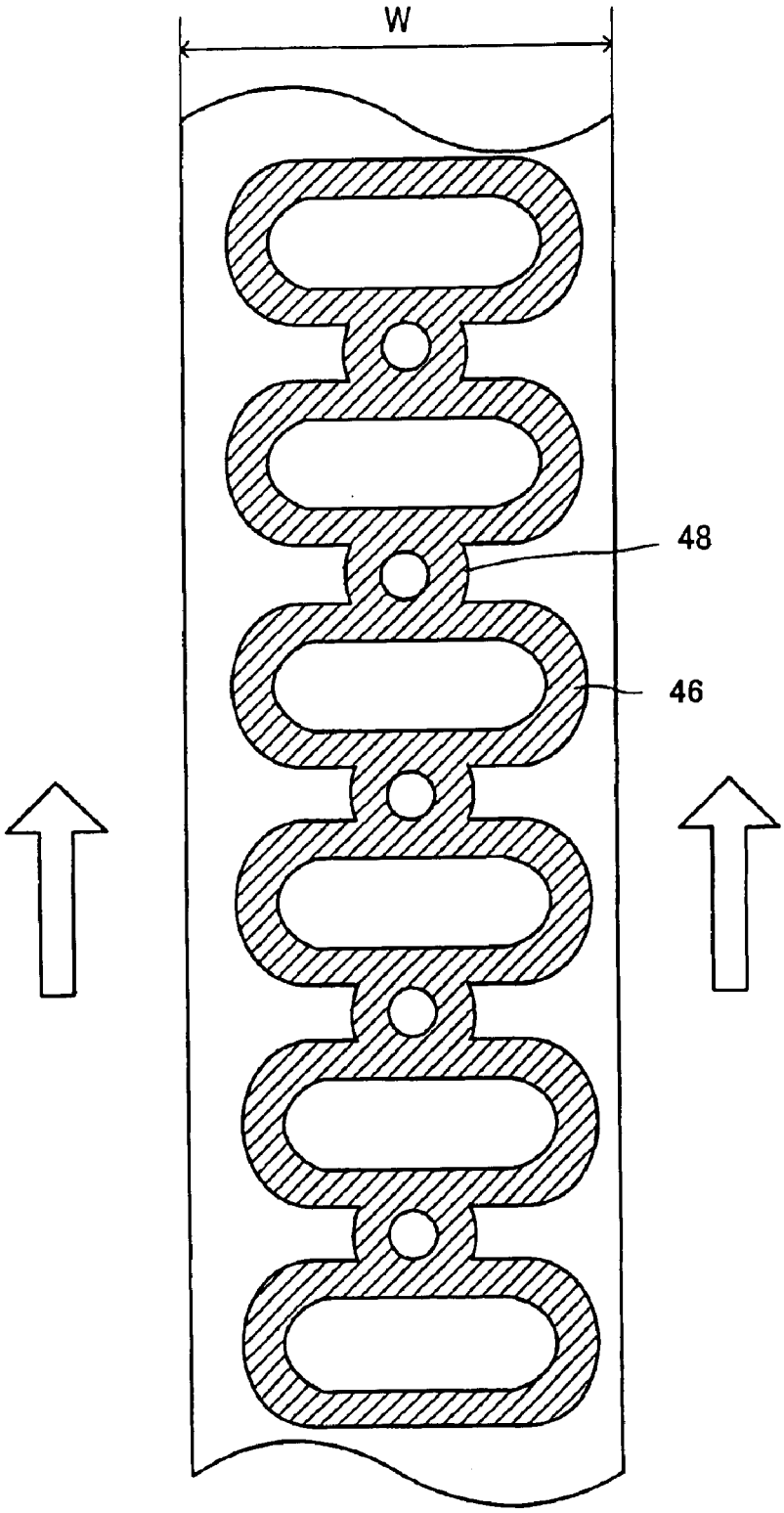
FIG. 13 is a plan view showing an example of the bonding pattern of the surgical gown according to the embodiment.

The bonding pattern shown in FIG. 13 includes a combination of ellipse portions 46 that are long in a width direction and small circle portions 48, and the ellipse portions 46 and the small circle portions 48 are alternately combined in the flow direction of the sheets. Each of the ellipse portions 46 and the small circle portions 48 is formed in a donut shape having a non-bonding portion therein. For example, the width W in the direction perpendicular to the flow direction of the sheets is set to 6 mm, the pitch of the ellipse portions 46 is set to 3.9 mm, and the inside diameter and the pitch of the circular portions 48 are set to 1 mm and 3.9 mm.

Figure 14:
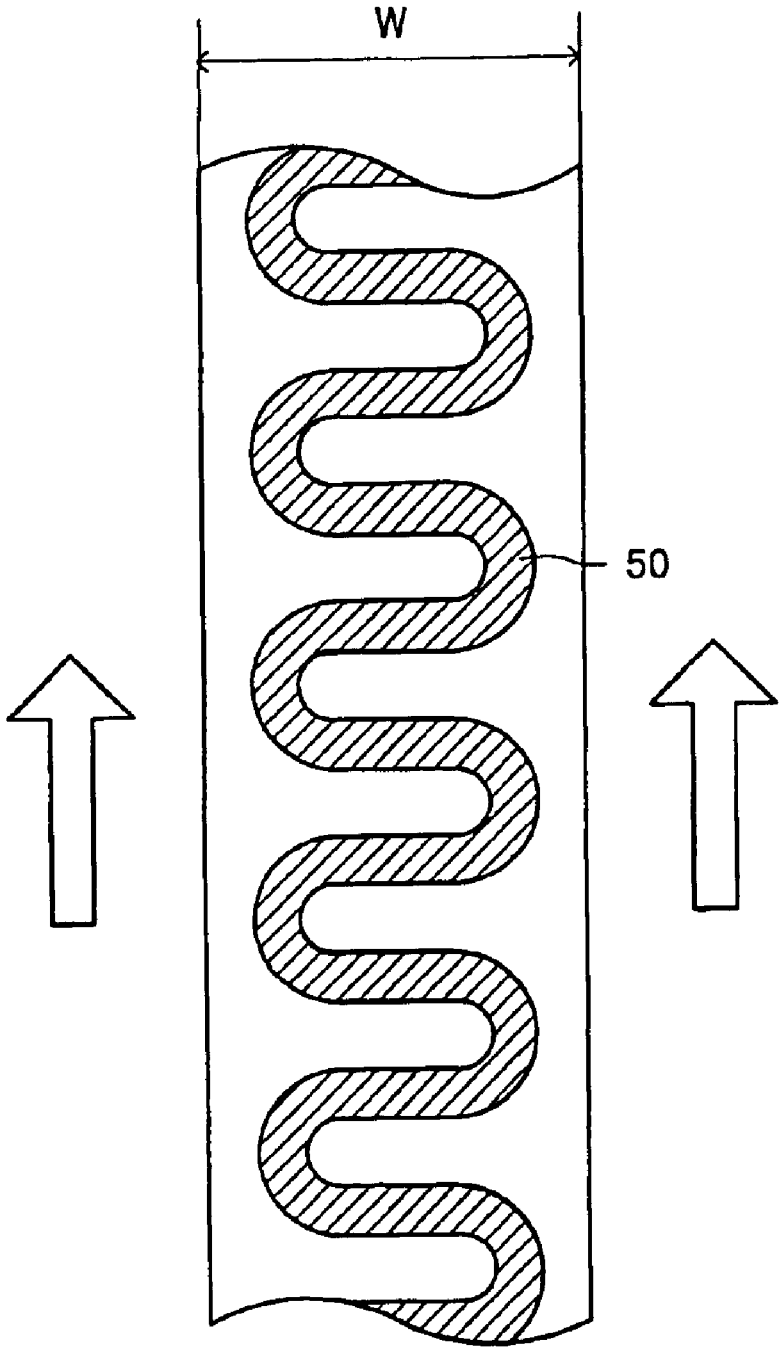
FIG. 14 is a plan view showing an example of the bonding pattern of the surgical gown according to the embodiment.

The bonding pattern shown in FIG. 14 includes a spiral pattern 50. For example, the width W of the pattern 50 in the direction perpendicular to the flow direction of the sheets is set to 6 mm, the pitch of spirals is set to 2.5 mm, and the width of non-bonding region in the flow direction of the sheets is set to 1.5 mm.

Figure 15:
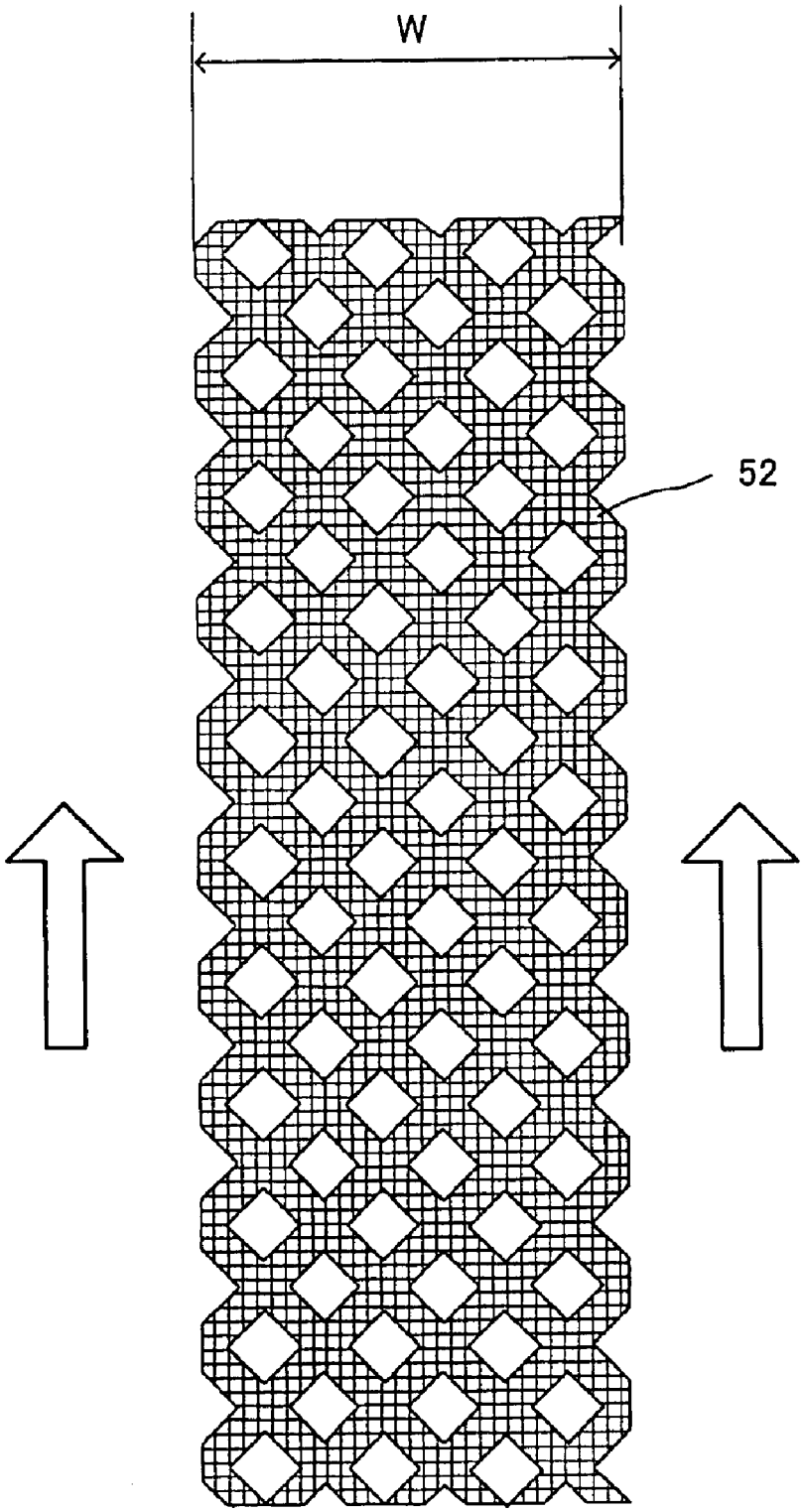
FIG. 15 is a plan view showing an example of the bonding pattern of the surgical gown according to the embodiment.

The bonding pattern shown in FIG. 15 includes a lattice-shaped pattern 52 that intersects at 45°. For example, the width W of the pattern 52 in the direction perpendicular to the flow direction of the sheets is set to 7 mm, the width of the stripes that constitute a lattice is set to 0.7 mm, and the pitch of parallel stripes is set to about 1.7 mm.

As shown in FIGS. 6 to 15, a plurality of discontinuous bonding portions are arranged adjacent a continuous bonding line (both of them are formed at the same time), so that a pressure to disperse in the direction perpendicular to the flow direction of the sheets is dispersed. Accordingly, when sheets constituting the gown are bonded to each other by, for example, an ultrasonic sewing machine, and the like, the breakage of the gown, which would be caused by the concentration of the pressure to a local area of the continuous bonding line, can be prevented.

When the sheets that constitute the gown are sealed by fusion bonding, the width of the bonding line is preferably set to within the range of 0.1 to 15 mm and more preferably to within the range 0.5 to 10 mm. When the width of the bonding line is 0.1 mm or less, a line pressure in the direction perpendicular to the flow direction of the sheets increases, and thereby there is a possibility that a fusion bonded portion is broken. In contrast, when the width of the bonding line is 15 mm or more, the wearer has uncomfortable feeling and workability is lowered because the rigidity of the bonding portion itself is higher than that of the non-bonding portion.

As described above, the linear shape, the wave shape, the zigzag shape, the lattice shape, and the like can be employed as the pattern of the seal line, and it is also possible to combine these shapes with the dot-shaped (discontinuous) pattern to regulate the line pressure in the direction perpendicular to the flow direction of the sheets.

When the bonding line is formed by the adhesive, it is preferable to use the hot-melt adhesive. Exemplified as patterns, which are formed when the hot-melt adhesive is applied, are an all-over-applied pattern and a stripe pattern formed by a coater die, a net-shaped pattern formed by a gravure coater, a linear pattern formed by bead coating, and a spiral pattern, a wave-shaped pattern, a zigzag pattern, and the like regulated by air (not shown).

When the bonding portion of the sheets is formed by the adhesive, it is preferable to set the width of the bonding portion to 1 to 15 mm. When the width of the bonding portion is 1 mm or less, bonding strength for bonding the sheets is lowered, and there is a possibility that the sheets are exfoliated while they are used. It is preferable that the bonding strength is 980 mN/25 mm or more in terms of exfoliation strength.

A spunbonded fabric formed of thermoplastic fibers, non-woven fabric such as spun lace, needle punch, melt-blown, thermal bond, chemical bond, a laminate sheet including non-woven fabric laminated to a thermoplastic resin sheet, and a three-layer structure including non-woven fabric, a thermoplastic resin sheet, and non-woven fabric can be used as the sheets used for the front and back bodies 4, 5A, and 5B and for both the sleeves 3A and 3B. Exemplified as a means for laminating the non-woven fabric to the thermoplastic resin sheet are direct laminating for extruding the thermoplastic resin sheet and fusing it, wet laminating performed using an adhesive, dry laminating, laminating performed using a hot-melt adhesive, heat embossing performed using heat or ultrasonic waves, and the like.

Polyolefine fibers, polyester fibers, polyamide fibers, and thick and thin type or side by side type composite fibers including polyethylene fibers and polypropylene fibers or polyester fibers can be used as the fibers constituting the non-woven fabric.

It is possible to form predetermined apertures to the non-woven fabric used as the sheets for constituting the surgical gown of the present invention in order to improve the air permeability thereof. Further, it is also possible to form concave and convex portions to the sheets by embossing them in order to improve the cushioning property of the sheets or to provide the sheets with an expanding/contracting property. A plastic sheet including polyethylene, polypropylene, polyester, polyurethane, or the like can be used as the thermoplastic resin sheet. Further, a composite non-woven fabric (SMS, SMMS non-woven fabric) including melt-blown non-woven fabric, which has high water resistance and both the surfaces of which are sandwiched between the sheet surfaces of spunbonded non-woven fabric having high strength and abounding with flexibility also can be used.

It is preferable that the entire strength of these sheets be at least 2500 mN/25 mm and that the vapor permeability thereof be at least 800 $g/m^2 \cdot 24$ hours. When the strength of the sheets is less than 2500 mN/25 mm, there is a possibility that the sheets are broken when the wearer moves. Further, when the vapor permeability is less than 800 $g/m^2 \cdot 24$ hours, the wearer gets stuffy and has uncomfortable feeling.

When the surgical gown according to the embodiment arranged as described above is to be worn, an assistant such as a nurse, or the like inserts hands into the auxiliary pockets 20A and 20B and spreads the gown both right and left. Next, a doctor, who wears operating gloves, wears the gown by inserting hands through the cuffs without coming into contact with the outside surface of the gown. Sweat coming from the vicinity of the face of the doctor during a surgical operation is absorbed by the absorbent sheet 22 located at his or her neck.

While the embodiment of the present invention has been described above, the present invention is by no means limited thereto, and it is needless to say that the design of the surgical gown may be appropriately varied within the range of the spirit disclosed in the appended claims. In particular, the sheets constituting the surgical gown need not be always different in the front body and the back bodies, and further any type of sheet cutting (patterning) method may be employed.

As described above in detail, since the bonding portions of the sheets constituting the surgical gown are continuously bonded in the present invention, the bonding portions are neither exfoliated nor broken even if the wearer moves intensely. Further, the exudation of substances such as blood from the bonding portions of the sheets can be prevented because no clearance is formed in the bonding portions due to the continuously formed bonding line. As a result, the effect of preventing infection between a patient and a wearer (doctor or nurse) of the surgical gown can be improved.

What is claimed is:

1. A disposable surgical gown, comprising:

a main body including a front body and a back body; and sleeves extending from both sides of upper ends of the main body, wherein the main body comprises a plurality of assembly sheets having air permeability and liquid non-permeability, the assembly sheets being bonded to each other only along edges of the sheets using a continuous bonding line that extends only along edges of the sheets.

2. A disposable surgical gown according to claim 1, wherein the bonding line is any one of a fusion-bonded seal line and a seal line using an adhesive.

3. A disposable surgical gown according to claim 1, wherein the bonding line is formed to be any one selected from a linear or straight bonding line, a wave-shaped bonding line, a zigzag bonding line, a lattice-shaped bonding line, a spiral bonding line, or a combination thereof.

4. A disposable surgical gown according to claim 1, wherein a plurality of discontinuous bonding portions are arranged adjacent the continuous bonding line.

5. A disposable surgical gown according to claim 1, wherein the bonding line is formed while the sheets are flowing along an assembly line; and the width of the bonding line in a direction perpendicular to the flowing direction of the sheets is set to 0.1 mm to 15 mm.

6. A disposable surgical gown according to claim 1, further comprising:

an auxiliary member, which is provided at an inner upper end of the back body, wherein the auxiliary member is folded by an assistant when the gown is worn by a wearer.

7. A disposable surgical gown according to claim 6, wherein the auxiliary member comprises two parts which are arranged at upper corners of the black body.

8. A disposable surgical gown according to claim 7, wherein the two parts of the auxiliary member are shaped to be triangle pockets.

9. A disposable surgical gown according to claim 1, further comprising:

a water-absorbent sheet provided around a neck portion of the front body for absorbing sweat of a wearer.

10. A disposable surgical gown according to claim 9, wherein the water-absorbent sheet is shaped and arranged so as not to extend outwardly from an upper edge of the front body.

11. A disposable surgical gown according to claim 6, further comprising:

a water-absorbent sheet provided around a neck portion of the front body for absorbing sweat of a wearer.

12. A disposable surgical gown, comprising:

a main body including a front body and a back body;

sleeves extending from both sides of upper ends of the main body; and an auxiliary member, which is provided at an inner upper end of the back body, wherein the auxiliary member is folded by an assistant when the gown is worn by a wearer.

13. A disposable surgical gown according to claim 12, wherein the auxiliary member comprises two parts which are arranged at upper corners of the back body.

14. A disposable surgical gown according to claim 13, wherein the two parts of the auxiliary member are shaped to be triangle pockets.

15. A disposable surgical gown according to claim 12, further comprising:

a water-absorbent body for absorbing sweat of a wearer.

16. A disposable surgical gown, comprising:

a main body including a front body and a back body;

sleeves extending from both sides of upper ends of the main body; and a water-absorbent sheet provided around a neck portion of the front body for absorbing sweat of a wearer.

17. A disposable surgical gown according to claim 16, wherein the water-absorbent sheet is shaped and arranged so as not to extend outwardly from an upper edge of the front body.

* * * * *